US010851988B2

(12) United States Patent
Rutherford et al.

(10) Patent No.: US 10,851,988 B2
(45) Date of Patent: Dec. 1, 2020

(54) INTEGRATED LIGHTING AND POWER FOR CABINETRY

(71) Applicant: Sensio America, LLC, Carol Stream, IL (US)

(72) Inventors: Gary B. Rutherford, Wheaton, IL (US); Paul Bardwell, Rexford, NY (US)

(73) Assignee: SENSIO AMERIA, LLC, Carol Stream, IL (US)

( * ) Notice: Subject to any disclaimer, the term of this patent is extended or adjusted under 35 U.S.C. 154(b) by 0 days.

(21) Appl. No.: 16/708,068

(22) Filed: Dec. 9, 2019

(65) Prior Publication Data

US 2020/0182453 A1 Jun. 11, 2020

Related U.S. Application Data

(60) Provisional application No. 62/777,195, filed on Dec. 9, 2018.

(51) Int. Cl.

| | |
|---|---|
| ***F21V 33/00*** | (2006.01) |
| ***F21S 2/00*** | (2016.01) |
| ***F21S 8/00*** | (2006.01) |
| ***F21V 23/00*** | (2015.01) |
| ***F21V 23/04*** | (2006.01) |
| ***F21V 23/06*** | (2006.01) |
| ***F21V 23/02*** | (2006.01) |
| ***A47B 97/00*** | (2006.01) |
| ***F21S 4/28*** | (2016.01) |
| *F21W 131/301* | (2006.01) |
| *F21Y 115/10* | (2016.01) |
| *F21Y 103/10* | (2016.01) |
| *F21Y 113/13* | (2016.01) |

(52) U.S. Cl.

CPC ..... *F21V 33/0012* (2013.01); *A47B 97/00* (2013.01); *F21S 2/005* (2013.01); *F21S 4/28* (2016.01); *F21S 8/03* (2013.01); *F21V 23/003* (2013.01); *F21V 23/02* (2013.01); *F21V 23/0435* (2013.01); *F21V 23/06* (2013.01); *A47B 2220/0077* (2013.01); *F21W 2131/301* (2013.01); *F21Y 2103/10* (2016.08); *F21Y 2113/13* (2016.08); *F21Y 2115/10* (2016.08)

(58) Field of Classification Search

CPC ..... F21V 33/0012; F21V 23/003; F21V 23/0435; F21V 23/02; F21S 2/005; F21S 8/03; F21S 4/28; F21Y 2115/10; F21Y 2103/10; F21Y 2113/13

USPC ..... 362/133

See application file for complete search history.

(56) References Cited

U.S. PATENT DOCUMENTS 9,374,856 B2 * 6/2016 Winton ..... H02H 9/041

* cited by examiner

*Primary Examiner* — Ali Alavi

(74) *Attorney, Agent, or Firm* — Lempia Summerfield Katz LLC

(57) ABSTRACT

An integrated lighting and power system for cabinetry includes a controller, a power lead connectable to the controller, and a powered light strip coupled to the power lead. The powered light strip has multiple channels. A plurality of light strip segments is connected to one another forming the powered light strip. Each light strip segment has one or more illumination elements. The controller is connected or connectable to a power source. The one or more illumination elements of a first segment of the plurality of light strip segments is connected to a first channel of the multiple channels and the one or more illumination elements of a second segment of the plurality of light strip segments is connected to a second channel of the multiple channels. The first and second channel and the first and second segments of the plurality of light strip segments are independently controllable via the controller.

20 Claims, 9 Drawing Sheets

INTEGRATED LIGHTING AND POWER FOR CABINETRY

RELATED APPLICATION DATA

This patent is entitled to the benefit of and claims priority to U.S. Provisional Application Ser. No. 62/777,195 filed Dec. 9, 2018 and entitled "Integrated Lighting and Power for Cabinetry." The entire contents of this prior filed application are hereby incorporated herein by reference.

BACKGROUND

1. Field of the Disclosure

This disclosure is generally related to power delivery and lighting for storage cabinets, and more particularly to an integrated power and lighting system and solution for cabinetry.

2. Description of Related Art

It is becoming common to incorporate lighting and lighting features into storage cabinets and cabinet systems when such cabinet systems are installed. For example, new kitchen designs often incorporate multiple zone cabinet lighting solutions amongst the cabinetry. Such cabinet systems can include wall cabinets and base cabinets. The wall cabinets can have an under-cabinet zone of lighting. This type of lighting can be provided for utility to illuminate the countertop and appliance work surfaces beneath the wall cabinets. Such cabinet systems can also include wall and base interior cabinet and drawer lighting. Interior lighting can provide utility to illuminate drawers and solid door cabinets when opened. This type of lighting can aid users in seeing the contents and interiors of such spaces. Zoned lighting can also be provided for aesthetics to illuminate wall and other cabinets with glass panels in the cabinet doors. This type of lighting can be employed to more softly illuminate the cabinet interiors and to highlight visible objects stored within such glass front cabinets. Such cabinet systems can also include upper soffit zoned lighting for illuminating areas above the tops of the wall cabinets. This type of lighting can be provided for soft or adjustable general illumination for a space that contains the cabinets.

The components of these lighting features are typically installed on site, once the cabinets are delivered, and during and/or after the cabinets are installed at the site. No matter the cabinet system or installation, the method of installing such lighting features or solutions is tedious, time consuming, and often complicated. This generally requires physical modification of the cabinets, such as drilling holes and the like. Further, the wiring that is required to accommodate cabinet lighting features typically includes a separate power connection to a power source for each different zone of the lighting arrangement. Power for each lighting zone must be connected both to the dedicated site power source and to the illumination elements or lights of each zone, such as the different lighting strips. A separate power cord is thus typically run from the lights in each zone to the power source. LED lights, and particularly LED lighting strips, are commonly used for lighting features and solutions for cabinet systems. Each zone or application noted above might require a different type of light source (bright task light, soft accent light, warm white or cool white light, colored light, etc.) to provide the specific desired light characteristics of a particular zone or application.

It is common to arrange a lighting system such that each zone is separately controlled for independent dimming and/or independent ON/OFF control. To achieve this, power is connected to the lighting features by plugging in or hard wiring a separate direct current (DC) power adapter for each zone to the on-site alternating current (AC) power source, such as a 120V AC system. In existing systems, each DC power adapter is then connected to the corresponding lighting feature or lights for that specific zone. In some cases, one or more of the zoned lighting features are intended to be a switched system and may be capable of being switched independent of any other zone. A switched wall socket may be provided at the site and each respective DC power adapter may be plugged into a switched socket. In other cases, one or more wall switches to operate the lights may be installed on site. The wall switches are then hard wired to the AC power source at the site and hard wired either to the respective DC power adapter for the lights or directly to the wiring for the lights for each switched zone. The different types of lighting features or zones noted above are each typically connected to a separate electrical power source, switch, or the like for independent control of each type of lighting. This can further complicate the on-site installation of the lighting systems and can drive up cost.

During a conventional installation of an illuminated cabinet system, the installer must prepare the lights for each cabinet, which may include cutting each LED strip to the appropriate length. The installer must also attach or install each light strip or element in the desired location for each cabinet, whether on top, within, or under each cabinet. The installer must also drill holes in the cabinets where wiring will run between adjacent cabinets to connect the lights of one particular feature on each cabinet to one another. The installer must also cut, trim, and run or route all of the wiring for each light strip or feature and then must connect all the wiring to the DC power sources and the AC power source and to the appropriate light strips or features. If the installer has two or three types or zones of lighting features, such as the under cabinet, interior cabinet, or above cabinet lighting, to install on multiple cabinets, the installer must measure for and drill holes for each feature, install the lights for each feature, prepare, run, and connect all of the wiring for each feature, and separately connect the power to each feature.

SUMMARY

In one example according to the teachings of the present disclosure, a cabinet system with integrated lighting and power includes a plurality of cabinets defining multiple illumination zones and a powered light strip having a power lead, a multi-channel configuration, and a plurality of light strip segments connected to one another. Each light strip segment has one or more illumination elements. The power lead is connected or connectable to a power source. At least a first segment of the plurality of light strip segments is connected to a first channel of the multi-channel configuration and at least a second segment of the plurality of light strip segments is connected to a second channel of the multi-channel configuration. The first and second channel and the first and second segments of the plurality of light strip segments are independently controllable. The one or more illumination elements of the first segment can controllably and independently illuminate a first zone of the of the multiple illumination zones and the one or more illumination elements of the second segment can controllably and independently illuminate a second zone of the multiple illumination zones.

In one example, the power lead can be coupled to a power converter or direct current (DC) driver.

In one example, the power lead can be configured to be plugged into a controller configured to control the first and second segments.

In one example, the powered light strip can be at least partly pre-installed on the two or more cabinets at a cabinet manufacturing facility.

In one example, the powered light strip can be at least partly installed on the two or more cabinets at an installation site.

In one example, the cabinet system can further include at least one component or accessory installed on one of the at least two cabinets. The at least one component or accessory can be powered by the powered light strip.

In one example, the one or more illumination elements can include light emitting diodes (LED's).

In one example, LED's on the first segment can produce a different light characteristic than LED's on the second segment.

In one example according to the teachings of the present disclosure, an integrated lighting and power system for cabinetry includes a controller, a power lead connectable to the controller, and a powered light strip coupled to the power lead. The powered light strip has multiple channels. A plurality of light strip segments is connected to one another forming the powered light strip. Each light strip segment has one or more illumination elements. The controller is connected or connectable to a power source. The one or more illumination elements of a first segment of the plurality of light strip segments is connected to a first channel of the multiple channels and the one or more illumination elements of a second segment of the plurality of light strip segments is connected to a second channel of the multiple channels. The first and second channel and the first and second segments of the plurality of light strip segments are independently controllable via the controller.

In one example, the controller can be coupled to a power converter or DC driver.

In one example, the power lead can be configured to be plugged into the controller.

In one example, the multiple channels can include four channels and a voltage channel.

In one example, the system can further include four different light strip segment types. Each segment type can be connected to a different one of four channels of the multiple channels.

In one example, different light strip segment types can be differentiated by differences in at least one illumination characteristic of the respective one or more illumination elements of two or more different light strip segment types.

In one example, the plurality of light strip segments can include multiple segments of each of two or more different light strip segment types.

In one example, the plurality of light strip segments can be arranged substantially in series. The multiple segments of each of two or more different light strip segment types can be arranged directly adjacent to one another or dispersed, at least in part, among the segments of the other different light strip segment types.

In one example, the one or more illumination elements can be LED's.

In one example, LED's on the first segment produce a different light characteristic than LED's on the second segment.

In one example, the system can further include a DC driver couplable to an AC power source. The controller can be connected to the DC driver and a plurality of the powered light strips can be connected to the controller.

In one example, at least two or more of the plurality of powered light strips can be independently connected to a controller. Common channels among the multiple channels of the plurality of powered light strips can be controllable together and independent of other channels of the multiple channels.

BRIEF DESCRIPTION OF THE DRAWINGS

The drawings provided herewith illustrate one or more examples or embodiments of the disclosure and therefore should not be considered as limiting the scope of the disclosure. There may be other examples and embodiments that may be equally effective to achieve the objectives and that may fall within the scope of the disclosure. Objects, features, and advantages of the present invention will become apparent upon reading the following description in conjunction with the drawing figures, in which.

The use of the same reference numbers or characters throughout the description and drawings indicates similar or identical components, aspects, and features of the disclosure.

DETAILED DESCRIPTION OF THE DISCLOSURE

Figure 1:
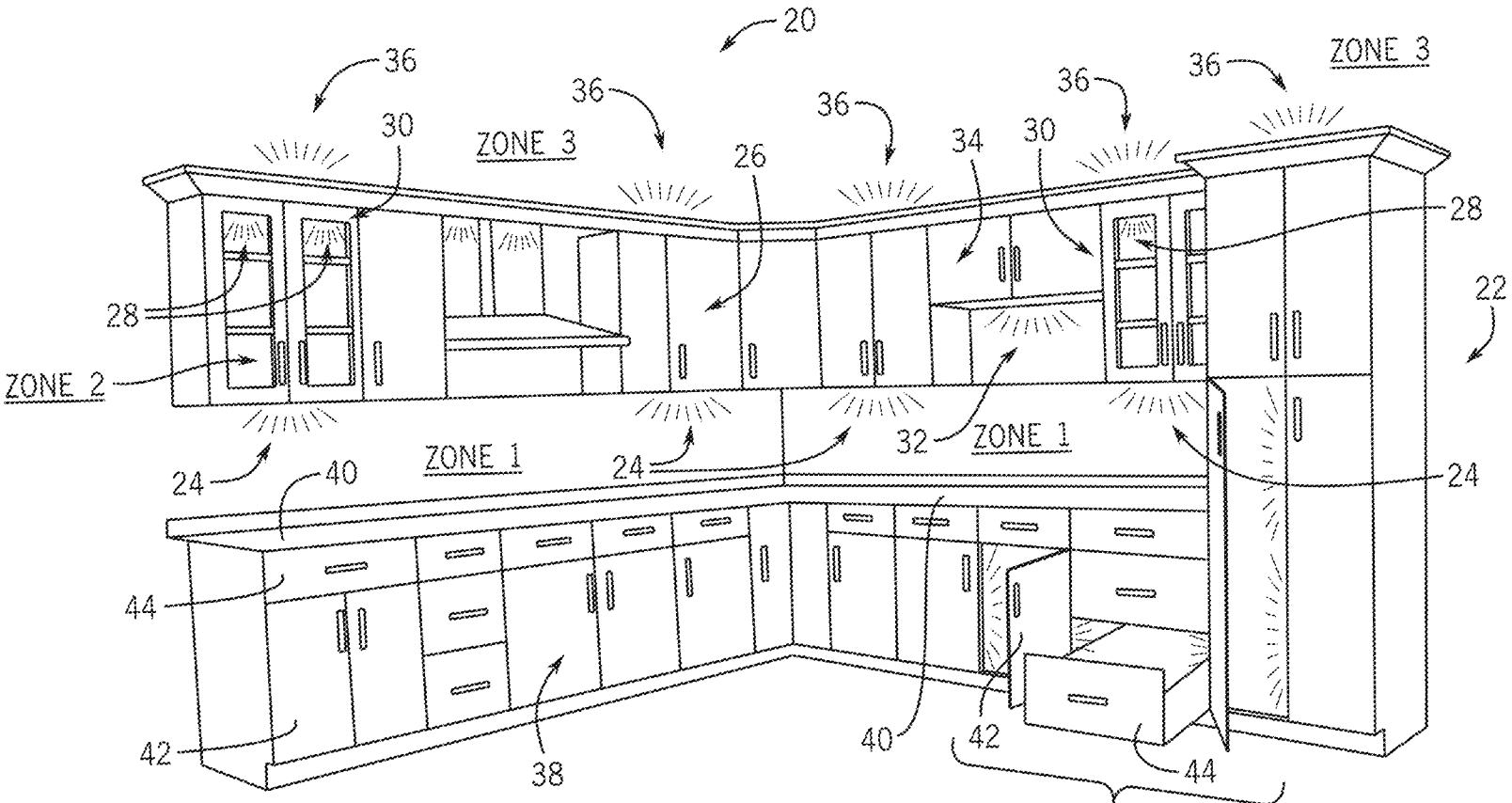
FIG. 1 shows a view of a generic cabinet arrangement and installation and including an integrated lighting and power system in accordance with the teachings of the present disclosure.

As used herein, the term "zone" or "zoned lighting" generally refers to a group of lights that are powered simultaneously by the same power channel of a lighting system to illuminate a specific part of a cabinet system. In most instances, this meaning also applies to a group of lights that are controlled (ON, OFF, DIM) together as a single unit for that part of the system. In most instances, each zone may be defined in a different part of a cabinet installation an illuminated in a different manner than and/or independent of one or more of the other zones. In some instances, two or more lighting options may be provided for lighting the same zone or part of a cabinet system, each lighting option providing a different lighting characteristic for that particular part or zone of the cabinet system. An exception is noted with regard to the solid door or panel interior cabinet and drawer lighting. In this example, the lights for this "zone" are or may be powered by the same power channel of the lighting system. However, separate controls or an added layer of control, such as an OPEN/CLOSE or ON/OFF switch, may be applied to each cabinet and/or each drawer. For this "zone", the lights for each cabinet and drawer may remain powered, but OFF, and may be turned ON independently of one another as a particular drawer or cabinet door is opened. Thus, it is understood herein that there may be a distinction for this type of "zone" because, unlike under-cabinet (task), over-cabinet (soffit), toe kick (base or floor level), or interior glass door cabinet lighting, the solid door and drawer lighting typically have independent control features. When the lights of most zones are turned on, turned off, or dimmed, all the lights of that group will behave the same. In contrast, when one opens a drawer and the light comes on, the similarly powered lighting of this "zone" in other drawers or in solid door cabinets need not behave the same and can remain turned off until that particular drawer or door is opened. However, for ease of description herein, this lighting is also identified as a "lighting zone," though it may behave differently.

The disclosed integrated lighting and power solution includes a powered light strip that has one power lead while also supporting multiple zone lighting capability and/or multiple lighting options in a given lighting zone. The light strip can include multiple light strip segments, at least one for each different lighting zone and/or part of a cabinet system. The disclosed integrated lighting and power solution is capable of independent control of each separate zone and/or channel along the light strip. The disclosed integrated lighting and power solution includes a gear or controller coupled to the light strip. The light strip and segments can be configured to have a multi-channel printed circuit board (PCB) form and may include single channel (monochrome) chips with illumination elements, such as light emitting diodes (LED's). The light strip segments can each have a different type of light source and can be connected in series, where each segment provides a different lighting characteristic for a corresponding zone of a cabinet system. Each light strip segment may have a different type of illumination element than the other strip or strips. Each light strip segment can be controlled using a different channel of the multi-channel PCB arrangement. The disclosed integrated lighting and power solution solves or improves upon one or more of the above-known and/or other problems and disadvantages with prior known cabinet lighting and power systems.

Turning now to the drawings, FIG. 1 shows one example of a cabinet system or installation 20. FIG. 1 depicts an image of kitchen cabinets or wall cabinetry 22 with lighting integrated amongst the cabinets. The cabinet system 20 depicted in FIG. 1 includes examples of countertop lighting 24 emanating from under a plurality of wall cabinets 26 of the wall cabinetry 22. The cabinet system 20 also includes interior lighting 28 emanating from within the interior of glass door cabinets 30 of the wall cabinetry 22. The cabinet system 20 further includes accessory lighting 32 emanating from beneath shorter height cabinets 34 and/or between spaced apart taller cabinets of the wall cabinets 26 of the wall cabinetry 22. The cabinet system 20 also includes soffit lighting 36 emanating from above the wall cabinets 26. The wall cabinetry 22 of the cabinet system 20 also includes interior lighting (not shown) within the interior of wall cabinets 26 with solid front doors 37. These interior lights provide illumination within the solid door cabinets 26 when opened.

The cabinet system 20 depicted in FIG. 1 is only one of innumerable different possible examples of a kitchen cabinet installation or system that is suitable for the disclosed integrated lighting and power solution. The number, type, and arrangement of the cabinets can vary widely. Other cabinet systems and installations, such as for bathrooms, work rooms, bedrooms, closets, and the like, as well as those specific to kitchens, may also benefit from employing the disclosed integrated light and power solution. The cabinet system and installation image of FIG. 1 is provided only to illustrate how the disclosed solution may be employed to improve upon or enhance the cabinetry and the installation process for such cabinetry. The cabinet system 20 in this example also includes base cabinetry 38 below countertops 40 and spaced beneath the wall cabinets 26. The base cabinetry 38 can include both solid door cabinets 42 and drawers 44. The base cabinetry can further include glass door cabinets, though not shown herein, that are similar in function to the glass door wall cabinets 30 noted above. The base cabinetry 38 of the cabinet system 20 can also include interior lighting (not shown) within the interior of the base cabinets 42 and the drawers 44. These interior lights can be configured to provide illumination within the solid door base cabinets 42 and/or drawers 44 when opened.

Virtually any cabinet arrangement and installation, and installation method, could be enhanced using the disclosed integrated lighting and power solution. Regarding the wall cabinetry 22, some cabinets may be joined together side to side at the same height. Other cabinets may be joined together side to side at different heights (known as castling), though not shown herein. Some cabinets may have different depths and some cabinets may have shorter heights, such as the shorter cabinets 34 in this example, than adjacent cabinets. Coastlining variations and arrangements (i.e., the depth and height contours of the cabinets) in both the horizontal and vertical directions is common.

As depicted in FIG. 1, the cabinet system 20 may have a plurality of different lighting zones or power channels (defined further below). In the illustrated example, the cabinet system 20 in this example includes four (4) different zones with lighting and power requirements. In other examples, the number of zones can vary from two zones to more than four zones, if desired. Also, as discussed further below, the configuration of the light strip segments and lighting options for a given zone or part of a cabinet system may also vary from this example. For ease of description in this example, a first zone, Zone 1 may include the countertop or under-cabinet lighting 24 and the accessory lighting 32. A second zone, Zone 2, may include the interior cabinet lighting 28 for glass door cabinets. A third zone, Zone 3, may include the above-cabinet or soffit lighting 36. A fourth zone, Zone 4, may include the interior cabinet lighting for the solid door cabinets and drawers. The Zones 1-4 in this example are each powered by separate power channels and define four separate powered applications for cabinet lighting to be illuminated independently according to the teachings of the present disclosure. As noted above and further below, a cabinet system may include two (2) zones, three (3) zones, four (4), or more zones that are separately controllable lighting zones, power channels, or powered applications.

The phrases multi-zone and multi-channel, as used herein, are intended to refer to any of these types of systems that have at least two different illumination zones or channels, where the zones or channels are separately controllable and may or may not have different illumination requirements.

Figure 2:
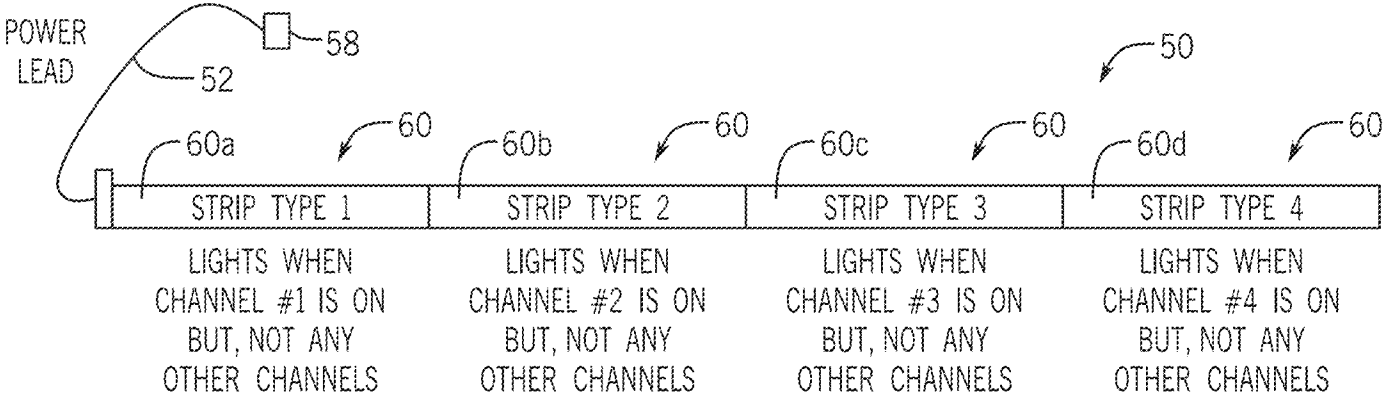
FIG. 2 shows a simplified schematic view of one example of a powered, multi-zone, light strip constructed in accordance with the teachings of the present disclosure.

FIG. 2 shows one simplified example of a powered light strip 50 constructed according to the teachings of the present disclosure. In this example, the light strip 50 includes a power lead 52 that is connectable to a gear or controller 54 (see FIG. 5 below), which is then connected to a DC power converter 56 at an installation site (see FIG. 5 below). The power lead 52 may optionally be configured to be hard wired directly to the primary AC source of power at the site but is more likely to have a connectorized attachment to the gear or controller 54 that includes or is coupled to the DC power source. The power lead 52 may be configured having a multi-prong plug 58 ($n^+$ number of channels) that can be plugged into a socket (not shown) on the gear or controller 54 at the installation site, where the socket or the gear or controller 54 is connected to the DC power source. The power lead 52 may also instead have a dedicated power converter (such as AC to DC conversion) or driver as a part of the lead.

As shown in FIG. 2, the powered light strip 50 can have multiple light strip segments, which can be joined to one another in series. Hereinafter, the light strip segments are collectively referred to as the light strip segments 60 and individually referred to as light strip segments 60*a*, 60*b*, 60*c* . . . 60*n*$^+$. One or more light strip segments 60 can carry an illumination source or light element, such as LED's, that is different from the other segments. One or more of the light strip segments 60 may carry LED's that are low power and produce a warm Kelvin illumination. For example, the soffit accent lighting 36 of Zone 3 below the short wall cabinets 34 in FIG. 1 does not need to be very bright while still providing a pleasant effect. The throw distance of such lighting 36 may be limited but may be satisfactory to provide the desired accent lighting effect. Thus, warm Kelvin illumination may be utilized for the light strip segment or segments 60 of Zone 3 in the example of FIG. 1. These light strip segments 60 would be connected to a specific one of the power channels of the system.

One or more of the light strip segments 60 may carry LED's that are slightly higher power and produce a cool white illumination. For example, the interior application of the solid door cabinets 26 and 42 and drawers 44, i.e., Zone 4 herein, may require moderate illumination and may be illuminated when a door or a drawer is opened. The intent is to provide utility light just when the door or drawer is open. In this instance, visual acuity may be more important than trying to match the other lighting in the room. Thus, a simple cool white LED or illumination source may be used for the light strip segment or segments 60 of Zone 4 in the example of FIG. 1. These light strip segments 60 would be connected to a specific but different one of the power channels of the system.

One or more of the light strip segments 60 may have LED's that are still higher power and higher wattage. For example, the under-cabinet lighting 24 of Zone 1 below the wall cabinets 26 in FIG. 1 may generally be more oriented toward task lighting. Thus, one or more of the light strip segments 60 could include higher wattage LED's or illumination elements. One may want the task lighting 24 to match the other lighting in the room. Thus, the LED's or illumination elements of the Zone 1 light segment or segments 60 may be provided and configured to produce warm white light. These light strip segments 60 would be connected to another specific but still different one of the power channels of the system.

One or more of the light strip segments 60 may have LED's that are low or medium wattage but also produce a warm white light. For example, the interior cabinet lighting 28 of Zone 2 in FIG. 1 for the cabinets 30 with glass doors may be more for accent lighting. However, because the lighting is visible from within the room, even with the doors closed, one may prefer that the light more closely match the other room lighting. Thus, the LED's or illumination elements of the Zone 2 lighting strip segment or segments 60 may be low or medium wattage at warm white. These light strip segments 60 would be connected to yet another specific but also different one of the power channels of the system.

In another example, one of the power channels may be used to provide voltage, i.e., independent controllable DC power, to power, charge, or operate other products or components instead of to provide zoned lighting or lighting applications. For example, one channel of the powered light strip 50 may be connected to a fan (not shown) that is mounted somewhere in the storage space. The fan may be controlled by operating the prescribed channel. A remote control 61 may be provided that can control each of the multiple channels of the powered light strip 50 separately. The remote control 61 can be used to turn all of the lights of a zone ON or OFF and to dim a zone. If another powered object, such as an electronic device, charger, product, component, or accessory, such as a fan, is connected to one of the channels, the powered object can be controlled using the remote control 61. In the case of a fan, when the channel is turned ON, the fan will operate. When the channel is turned OFF, the fan will be turned off. When the dimming function of the channel is used, the fan speed may be controlled or controllable.

The same power channel or other channels may be utilized in a similar fashion to control other powered devices, products, components, or accessories, such as speakers, timers, Bluetooth devices, chargers, or the like. Also, one or more channels of the powered light strip 50 may go unused in any given installation, if desired. The solution can be used and varied to accommodate a wide variety of lighting systems and arrangements and cabinet systems and installations. As should now be clear, the number of channels defined by the powered light strip 50 can vary from the disclosed example of four such channels. Further, the number of light strip segments 60 included in a given powered light strip 50 can also vary greatly, depending on the distance the strip must extend and the circuitous route the strip must take throughout a cabinet system 20.

Each of the light strip segments 60 of a light strip 50 in the disclosed example may be a monochrome strip with only one type of LED or illumination source connected to a specific one of the channels. The entire light strip segment 60 is controlled by the specific one channel of the system. As shown in FIG. 2, one simplified example of the light strip 50 includes four different light strip segments 60*a*, 60*b*, 60*c*, and 60*d* connected to one another in series. The light strip 50 includes the power lead 52, which in this example may be a four channel, red-green-blue-white (RGBW) type of lead, coupled to the multi-prong plug 58. The first light strip segment 60*a* in this example includes LED's 62*a* that produce a certain type of light and that are only illuminated when the first or RED (R) channel is powered or ON but are not illuminated when only the other channels are powered or ON. The second light strip segment 60*b* in this example includes LED's 62*b* that produce a certain type of light, which may be the same as or different than the light produced by the LED's 60*a*. The LED's 62*b* are only illuminated when the second or GREEN (G) channel is powered or ON but are not illuminated when only another channel or channels is/are powered or ON. The third light strip segment 60*c* in this example includes LED's 62*c* that produce a certain type of light, which again may be the same as or different than the light produced by either or both of the LED's 60*a* and 60*b*. The LED's 62*c* are only illuminated when the third or BLUE (B) channel is powered or ON but are not illuminated when only another channel or channels is/are powered or ON. The fourth light strip segment 60*d* in this example includes LED's 62*d* that produce a certain type of light, which again may be the same as or different than the light produced by any one or more of the LED's 60*a*, 60*b*, and 60*c*. The LED's 62*d* are only illuminated when the fourth or WHITE (W) channel is powered or ON but are not illuminated when only another channel or channels is/are powered or ON.

As shown in FIGS. 2 and 3A-E, similar to the power lead 52, the powered light strip 50 and the light strip segments 60 may be configured to have the form of a multi-channel PCB. The PCB form of the light strip segments 60 can match the lead 52 configuration, such as having a RGBW LED strip configuration. Thus, in this example, the PCB form is a four-channel PCB form, which allows for four separately controllable aspects of the powered light strip 50. Each light strip segment 60*a*, 60*b*, 60*c*, . . . 60*n*$^{+}$ or group may be connected to only the correct channel or channels of the PCB strip form and thus powered up only when the specific channel or channels is activated or operated.

Figure 3A:
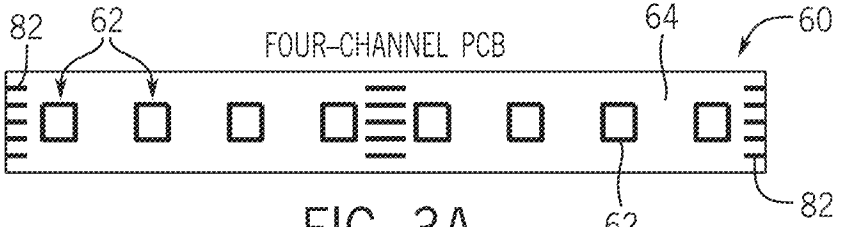
FIGS. 3A-3E shows a schematic view of examples of printed circuit board configurations for light strip segments of the light strip of FIG. 2 and in accordance with the teachings of the present disclosure.
Figure 3B:
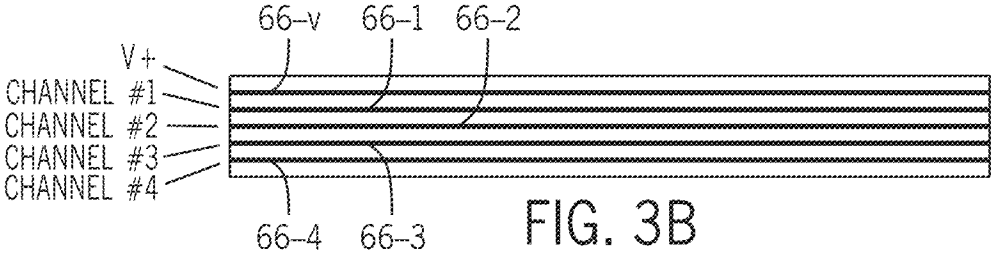
Figure 3C:
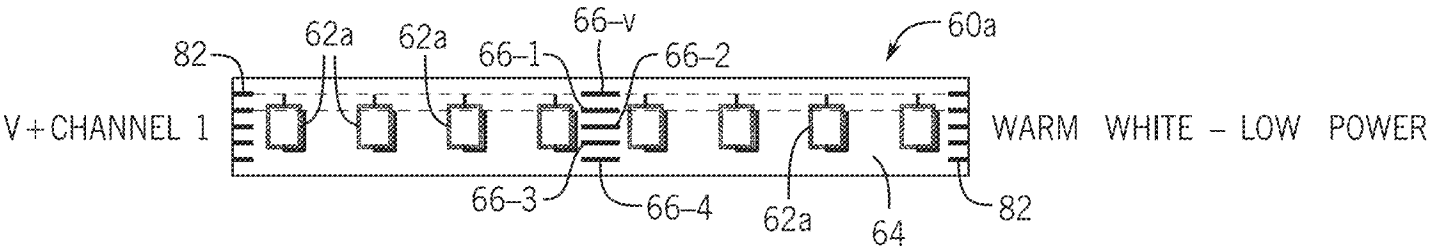
Figure 3D:
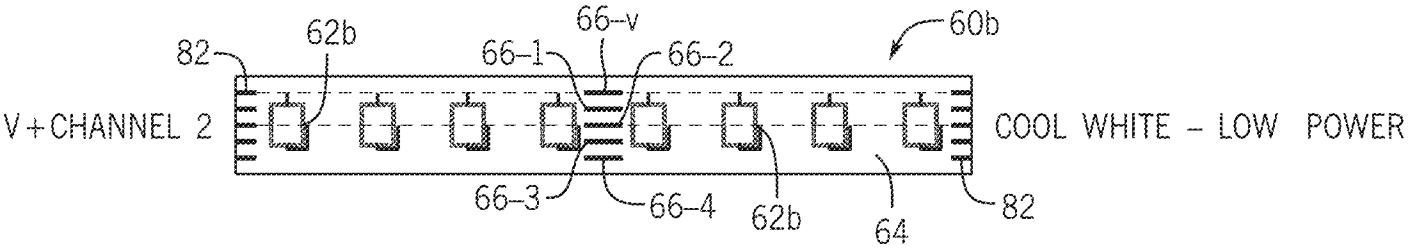
Figure 3E:
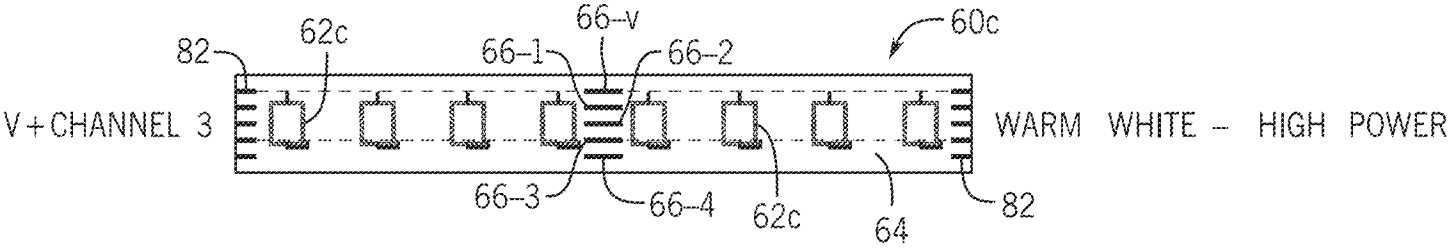

According to FIGS. 3A-3E, the four-channel PCB form provides the flexibility to have a very customizable cabinet lighting solution. FIG. 3 shows one example of a PCB form for the light strip segments 60. Power to each zone can be provided from a single power lead 52, but each zone can be controlled by a separate channel of the PCB form, such as ON/OFF/DIM, independently. In this example, FIGS. 3A and 3B show a top view and a bottom view of a generic PCB light strip segment 60. FIGS. 3C-E show three different arrangements of the PCB form to create different functioning light strip segments 60*a*, 60*b*, and 60*c*, for example. FIG. 3A shows a top view of a light strip segment 60 including a strip substrate 64 and a plurality of the LED chips 62 carried on a top side of the substrate. FIG. 3B shows a bottom view of the light strip segment 60. The strip substrate 64 includes five traces or channels 66-1, 66-2, 66-3, 66-4, and 66-*v*. The trace or channel 66-*v* is a powered voltage or current trace connected to the DC converter 56 and the controller 54 and the traces or channels 66-1 to 66-4 define four separate channels along the strip segment 60.

In one example shown in FIG. 3C, a generic strip segment carrying warm white, low power LED chips 62*a*, can be further configured by connecting a first one of the traces or channels 66-1 to the LED chips and to the voltage trace 66-*v*. The strip segment can thus be further constructed using the PCB form to create a strip segment 60*a* whereby the LED chips 62*a* are illuminated by powering the voltage trace 66-*v* and the first trace or channel 66-1 with current. In another example shown in FIG. 3D, a generic strip segment carrying cool white, low power LED chips 62*b* can instead be further configured by connecting a second one of the traces or channels 66-2 to the LED chips and to the voltage trace 66-*v*. The strip segment can thus be further constructed using the PCB form to create a strip segment 60*b* whereby the LED chips 62*b* are only illuminated by powering the voltage trace 66-*v* and the second trace or channel 66-2 with current. In another example shown in FIG. 3E, a generic strip segment carrying warm white, high power LED chips 62*c* can instead be further configured by connecting a third one of the traces or channels 66-3 to the LED chips 62*c* and to the voltage trace 66-*v*. The strip segment can thus be further configured using the PCB form to create a strip segment 60*c* whereby the LED chips 62*c* are only illuminated by powering the voltage trace 66-*v* and the third trace or channel 66-3 with current. Though not depicted, a generic strip segment similar to those of FIGS. 3A and 3B can instead be further configured in a similar manner to illuminate LED chips 62*d* only when the fourth trace or channel 66-4 is powered. This can be done by connecting and powering LED chips 62*d* on a strip 62*d* to the fourth trace or channel 66-4 and the voltage trace 66-*v* with current.

Within or along the powered light strip 50, multiple light strip segments 60 of the same type, such as multiple strip segments 60*a* can be joined directly together in series to cover a specific larger zone. Multiple light strip segments 60 of the same type can also be joined in series, but indirectly and dispersed among other different light strip segments for different zones. This type of arrangement can be used to cover different parts of the same zone that are separated from one another by other cabinets and zones in the cabinet system or installation. The light segments of a particular zone simply need to be connected to one another electrically and the LED chips 62 of those segments connected to the correct trace or channel of the PCB form of the light strip segment in order to be operated and controlled together, while not operating or controlling the other zones. In other words, if power is selectively applied, via the controller 54, only to the voltage trace 66-*v* and to the first channel 66-1, but not to channels 66-2, 66-3, and 66-4, only the strip segments 60 along the light strip 50 with LED's connected to the first channel will be illuminated. Any of the zones associated with the four channels can be controlled independently in this manner while power is applied at only one point to only one end of the powered light strip 50 to power the entire strip. The controller can be programmed to independently operated each channel of the light strip.

Figure 4A:
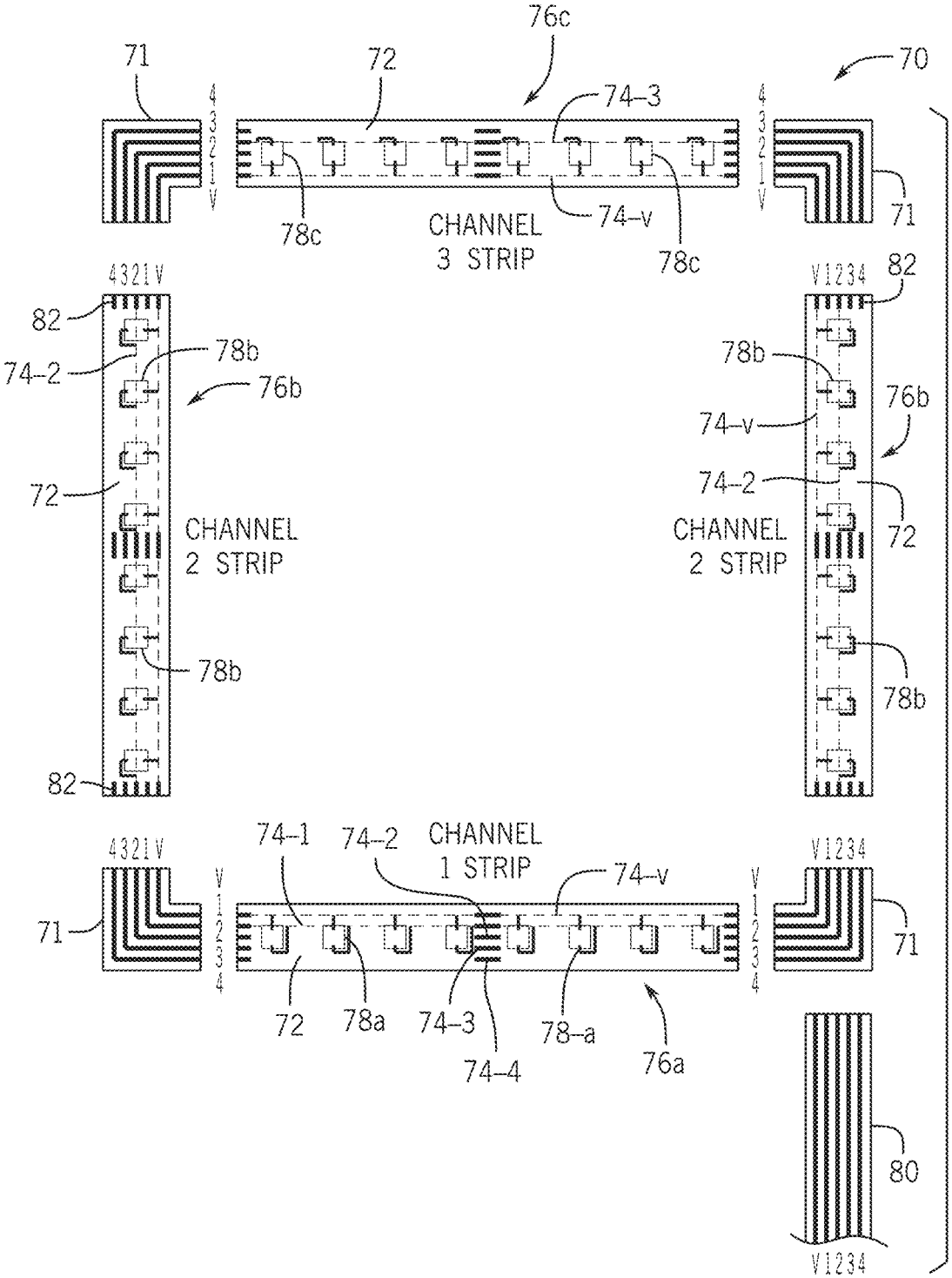
FIGS. 4A-4C show simplified and exploded views of powered light strips, such as that shown generically in FIG. 2 and in accordance with the teachings of the present disclosure.
Figure 4B:
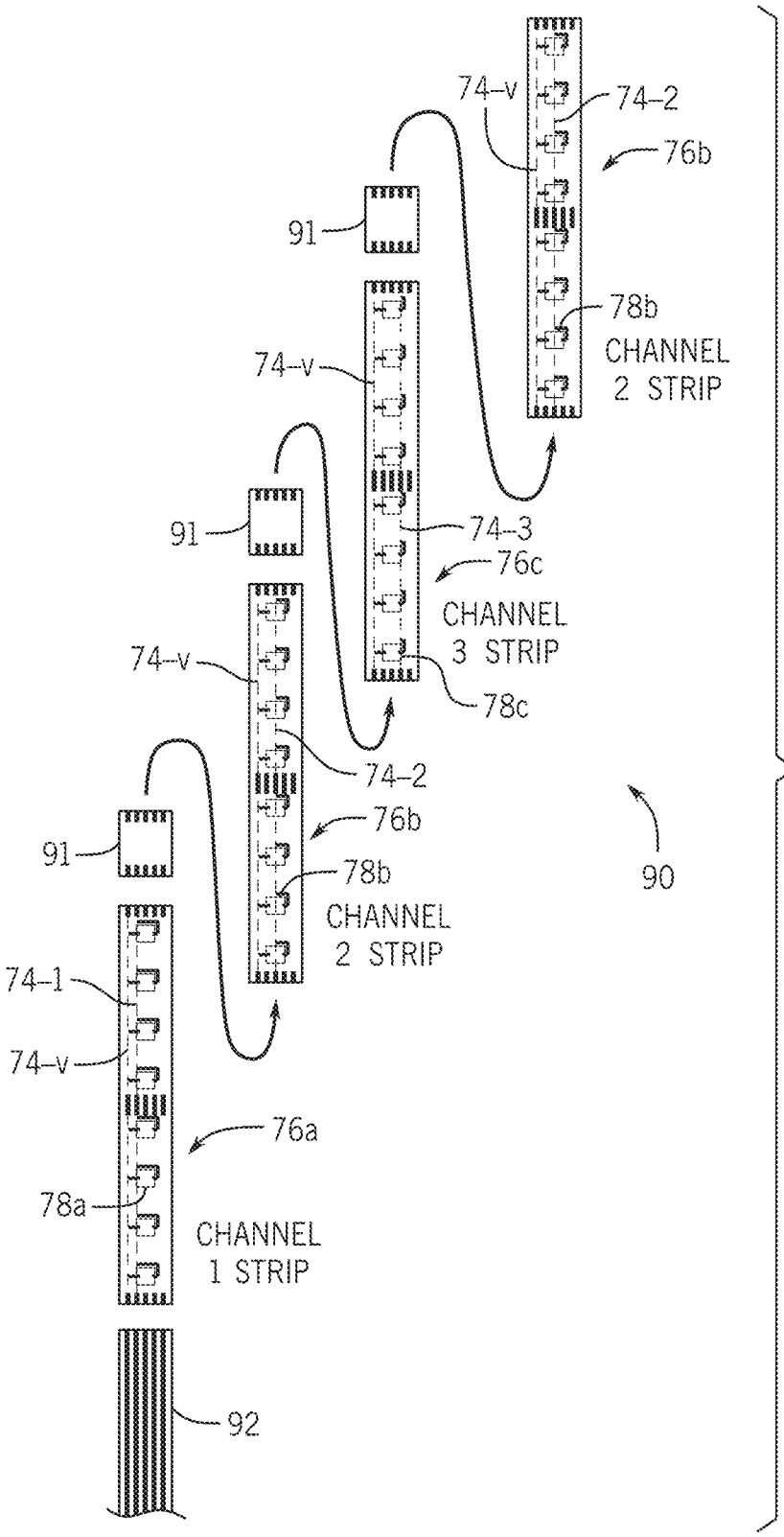
Figure 4C:
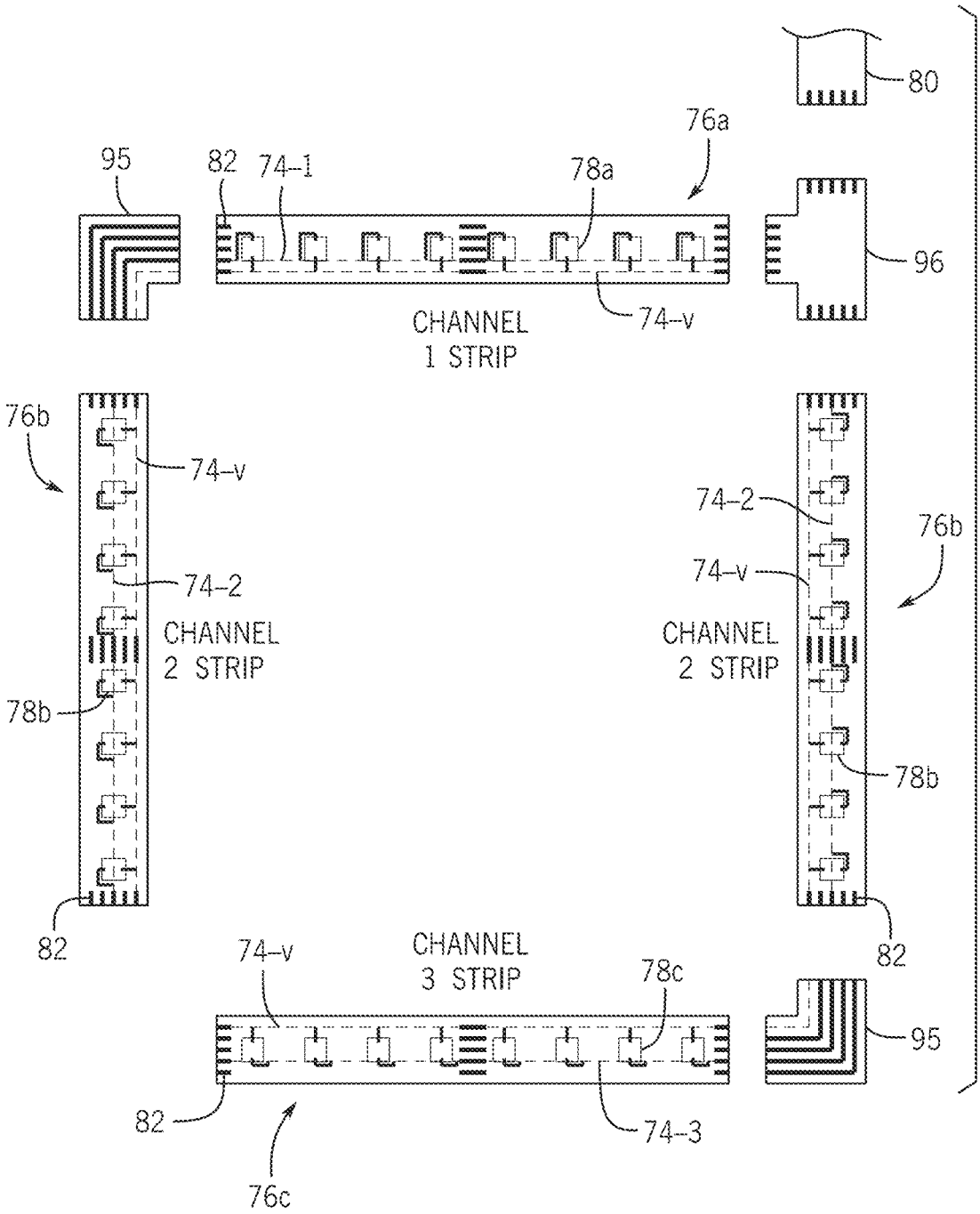

FIGS. 4A-4C show three different and simplified examples of powered light strips constructed in according to the teachings of the present disclosure. In FIG. 4A, a four-channel powered light strip 70 is provided with 90 degree corners for installation within a rectangular cabinet. The powered light strip 70 has four light strip segments joined to one another by right angle corner joints 71. The light strips segments each have a strip substrate 72 carrying a voltage channel 74-*v* and four channels 74-1, 74-2, 74-3, and 74-4. The light strip segments in this example include a channel one light strip segment 76*a* with LED chips 78*a* on the strip substrate 72. The LED chips 78*a* are powered by the voltage trace or channel 74-*v* and the first channel 74-1. The light strip segments in this example further include a channel two light strip segment 76*b* with LED chips 78*b* on the strip substrate 72. The LED chips 78*b* are powered by the voltage trace or channel 74-*v* and the second channel 74-2. The powered light strip 70 in this example has two of the channel two light strip segments. The light strip segments in this example also include a channel three light strip segment 76*c* with LED chips 78*c* on the strip substrate 72. The LED chips 78*c* are powered by the voltage trace or channel 74-*v* and the third channel 74-3. In this example, a fourth channel 74-4 is depicted as being unused. A four-channel power lead 80 can be connected to the light strip 70, such as at one of the corner joints. The power lead 80 and the corner joints can include separate traces corresponding to the voltage trace and the four separate channel traces of the light strip segments. The various traces of the corner joints and the adjacent light strip segments can be soldered together or otherwise electrically connected to form the powered light strip 70. Each of the channels or traces **74-*v*, 74-1, 74-2, 74-3, and 74-4 (as well as the corner joints 71) may include a contact 82 at each end of the substrate 72 (and corner joint 71**) to facilitate making the electrical connection between the light strip segments and the corner joints.

In FIG. 4B, a four-channel powered light strip 90 is provided having a linear configuration similar to the powered light strip 50 described above. The powered light strip 90 has four light strip segments joined to one another by optional linear end joints 91. The light strip segments in this example can be the same as in the prior example. Thus, each light strip segment can have a strip substrate 72 carrying a voltage channel **74-*v* and four channels 74-1, 74-2, 74-3, and 74-4. The light strip segments in this example again include a channel one light strip segment 76*a* with LED chips 78*a* on the strip substrate 72 and powered by the voltage trace or channel 74-*v* and the first channel 74-1. The light strip segments in this example further include a channel two light strip segment 76*b* with LED chips 78*b* on the strip substrate 72 and powered by the voltage trace or channel 74-*v* and the second channel 74-2. The powered light strip 90 in this example again has two of the channel two light strip segments. The light strip segments in this example also include a channel three light strip segment 76*c* with LED chips 78*c* on the strip substrate 72 and powered by the voltage trace or channel 74-*v* and the third channel 74-3. In this example, a fourth channel 74-4 is also depicted as being unused. A four-channel power lead 92 can be connected to the light strip 90, such as at one terminal end of the light strip. The power lead 92 and the end joints 91 can include separate traces corresponding to the voltage trace and the four separate channel traces of the light strip segments. The various traces of the end joints and the adjacent light strip segments can be soldered together or otherwise electrically connected to form the powered light strip 90. Each of the channels or traces 74-*v*, 74-1, 74-2, 74-3, and 74-4 (as well as the end joints 91) may include a contact 82 at each end of the substrate 72 (and end joint 91**) to facilitate making the electrical connection between the light strip segments and the end joints. Alternatively, the light strip segments in this linear example may be directly soldered or otherwise directly electrically connected end to end to one another.

In FIG. 4C, a four-channel powered light strip 94 is provided with a branched configuration including 90 degree corner joints and a linear joint, also for installation within a rectangular cabinet. The powered light strip 94 has four light strip segments, arranged in two separate branches and joined to one another by right angle corner joints 95 and a T-joint 96. The two separate branches are only joined to one another at one end, i.e., at the T-joint 96. The light strip segments in this example can be the same as in the prior examples. Thus, the light strip segments each again have a strip substrate 72 carrying a voltage channel **74-*v* and four channels 74-1, 74-2, 74-3, and 74-4. The light strip segments in this example include one light strip segment 76*a* with LED chips 78*a* on the strip substrate 72 and powered by the voltage trace or channel 74-*v* and the first channel 74-1. The light strip segments in this example further include a pair of opposed channel two light strip segments 76*b* with LED chips 78*b* on the strip substrate 72 and powered by the voltage trace or channel 74-*v* and the second channel 74-2. The light strip segments in this example also include a channel three light strip segment 76*c*, opposite the channel one light strip segment 76*a*, with LED chips 78*c* on the strip substrate 72 and powered by the voltage trace or channel 74-*v* and the third channel 74-3. In this example, the fourth channel 74-4 is again depicted as being unused. A four-channel power lead 80 can be connected to the light strip 70, such as at one linear end of the T-joint 96. The power lead 80, T-joint 96, and corner joints 95 can include separate traces corresponding to the voltage trace and the four separate channel traces of the light strip segments. The various traces of the corner joints and the adjacent light strip segments can be soldered together or otherwise electrically connected to form the powered light strip 94. Each of the channels or traces 74-*v*, 74-1, 74-2, 74-3, and 74-4 (as well as the corner joints 95 and T-joint 96) may include a contact 82 at each end of the substrate 72** (and corner joint and T-joint) to facilitate making the electrical connection between the light strip segments and the joints.

Figure 5:
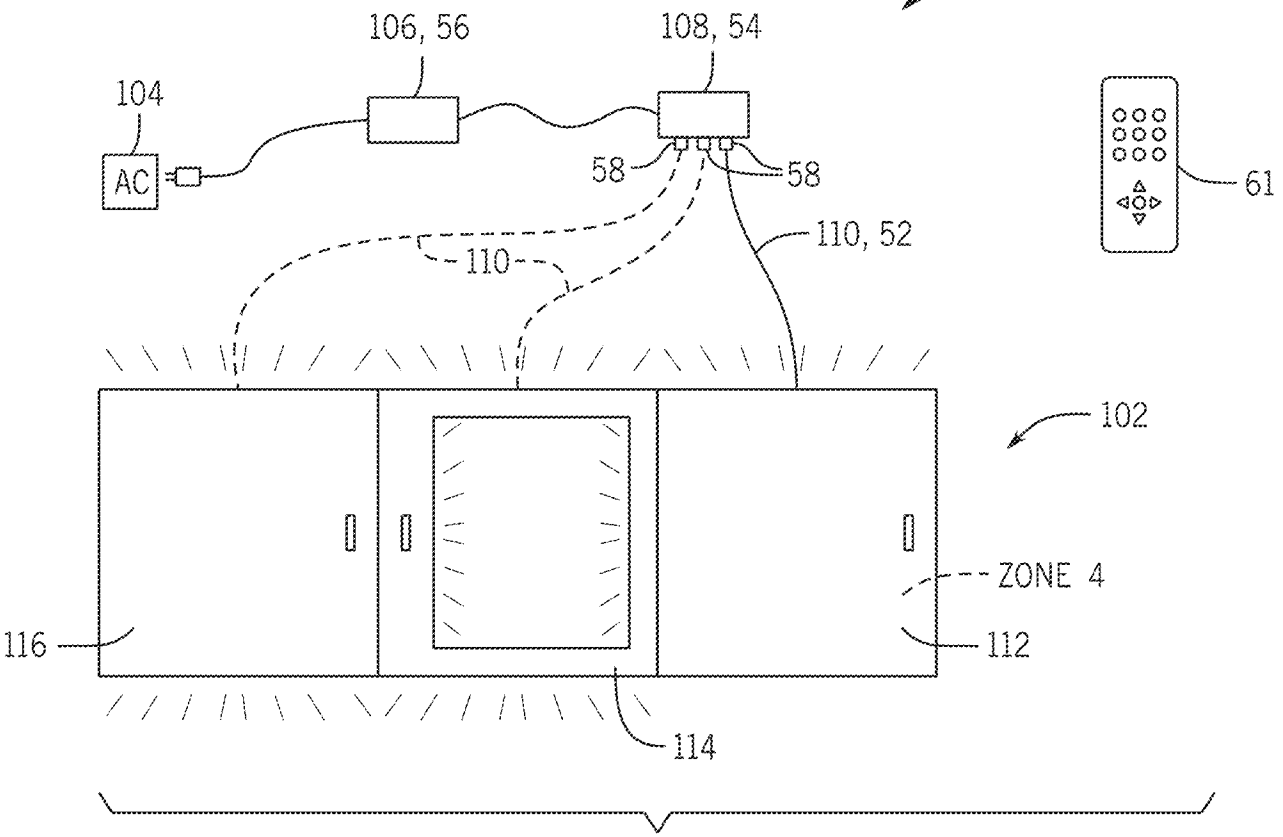
FIG. 5 shows a simplified schematic view of an integrated power and lighting system for cabinetry in accordance with the teachings of the present disclosure and utilizing a powered, multi-zone, light strip, such as is shown in FIGS. 2 and 4A-4C and incorporating light strip segments such as those shown in FIGS. 3A-3E.

FIG. 5 shows a generic, simplified schematic of one example of an integrated lighting and power system 100 for cabinetry 012. The system 100 includes an AC power source 104 at the installation site of the cabinetry 102. The system 100 also includes an AC to DC power converter or DC driver 106 coupled to the AC power source 104. The system 100 also includes a gear or controller 108 coupled to and powered by the DC driver 106. The controller 108 can be configured to operate the entire system according to desired performance parameters. Though not shown herein, the controller 108 can include a processor or can be connected (wired or wirelessly) to a remote device having a processor, such as a computer or handheld device. The processor can be configured and programmed to carry out independent control of each aspect of the system 100.

In one example, the cabinetry 102 can be configured to include one or more multi-function powered light strips (not shown), each of which is coupled to the controller by a lead 110. See FIG. 1 for one example of a four-zone integrated lighting and power arrangement. A single lead 110 may be utilized to connect to and power the entire system. However, in many instances, connecting one part of the system on one cabinet portion to another part of the system on another cabinet portion may be unwieldy or difficult. Further, connecting numerous portions of the entire system 100 to one another and then connecting the system to the controller 108 via a single lead 110 may result in unacceptable voltage drop across the system. For example, simple wire run length of the system may produce such voltage drop.

Thus, alternatively, multiple leads 110 may be used to power different portions (i.e., cabinet sections or cabinets) of the system 100, depending on the size and complexity of the cabinetry 102 and lighting employed for the cabinetry. As shown in FIG. 5, one cabinet section or cabinet 112 may include a multi-channel light strip (not shown) for independently illuminating the soffit space above the cabinet and the interior of the solid door cabinet, when opened. Thus, the cabinet section or cabinet 112 utilizes a first channel (soffit) and a second channel (bright white interior) of the system 100, for example. A second cabinet section or cabinet 114 may include a multi-channel light strip (not shown) for independently illuminating the soffit space above the cabinet, the visible interior of the glass door cabinet, and the task space below the cabinet. Thus, the cabinet section or cabinet 114 utilizes the first channel (soffit), a third channel (soft white interior), and a fourth channel (task) of the system 100, for example. A third cabinet section or cabinet 116 may include a multi-channel light strip (not shown) for independently illuminating the soffit space above the cabinet and the task space below the cabinet. Thus, the cabinet section or cabinet 114 utilizes the first channel (soffit) and the fourth channel (task) of the system 100, for example. Regardless of the number of leads 110, the controller 108 can be configured to independently control each channel of the system 100. Thus, all task lighting of the cabinetry 102 may be independently controlled together, all soffit lighting of the cabinetry may be independently controlled together, and so on.

In one example, the system 100 may include and be controlled via one or more simple hard-wired on/off wall switch (not shown) connected to the controller. In another example, the system 100 may be controlled via a wireless remote control 61 that communicates with the controller 108. The remote control 61 can vary in configuration and function. However, the remote control 61 should be able to independently operate each separate channel of the system 100 and control each separate function associated with each channel, such as ON, OFF, DIM, TIMER, and/or the like. In one example, the system 100 may be controlled via wireless communication with an electronic device (not shown), such as a smart phone and app, a tablet device and app, a computer or computer network, and/or the like. Again, the remote device can communicate with the controller 108. The remote device can again vary in configuration and function. However, the remote device should be able to independently operate each separate channel of the system 100 and control each separate function associated with each channel, such as ON, OFF, DIM, TIMER, and/or the like. In one example, the system 100 may be controlled by voice command via a network connection between the system and an internet of things device, such as an ALEXA, ECHO, or GOOGLE HOME system.

Figure 6:
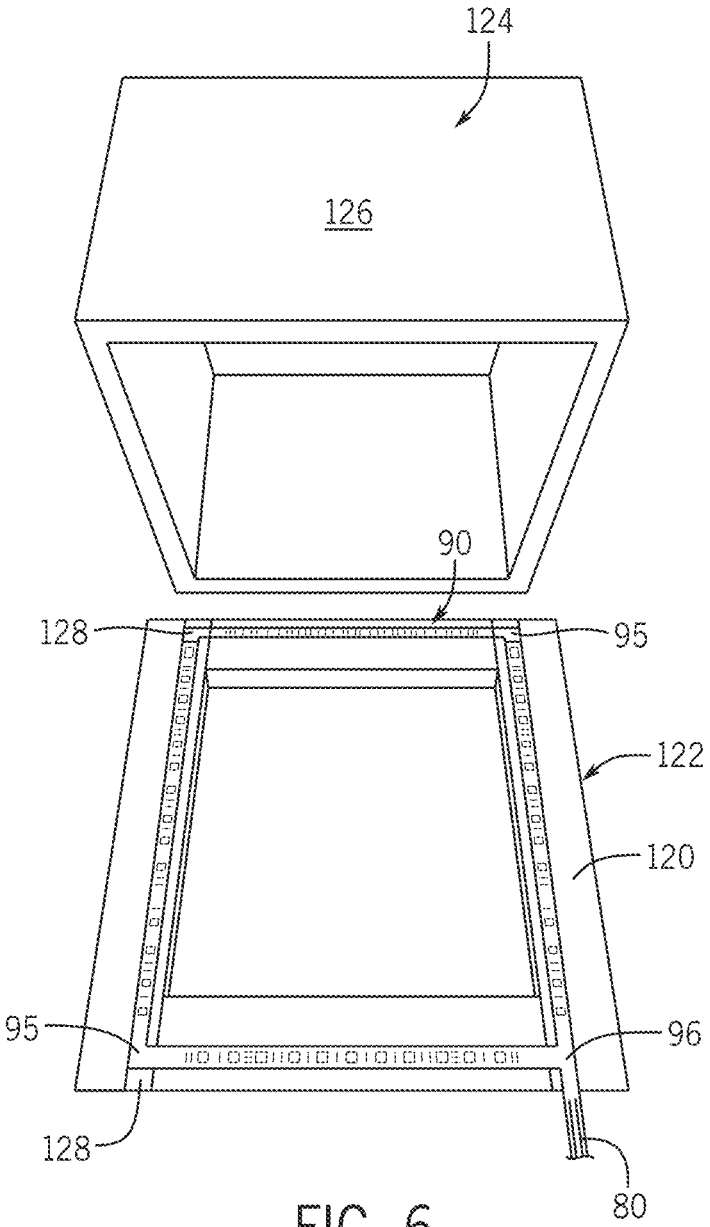
FIG. 6 shows a cabinet including a powered light strip configured in a manner like that shown in FIG. 4C and installed on the cabinet.

FIG. 6 shows the branched powered light strip 94 installed on an inside surface 120 a cabinet frame or facia 122 for a cabinet 124. In this example, the channel one light strip segment 76*a* will be positioned above a top surface 126 of the cabinet 124 (soffit lighting) and the channel three light strip segment 76*c* will be positioned below the cabinet (task lighting). The channel two light strip segments 76*b* will be positioned within the interior of the cabinet 124 (interior lighting). The power lead 82 extends upward above the cabinet to be connected to a controller. In this example, the powered lighting strip 94 is received in recessed grooves or dados 128 formed in the inside surface 120 of the frame 122 of the cabinet 124. As will be evident to those having ordinary skill in the art, the configuration, placement, and arrangement of the powered lighting strips and the cabinetry can vary widely from the simple examples shown and described herein. Each channel of the PCB form of the disclosed lighting strips and segments can be assigned to provide controllable power to only one type of light element or LED chip for one zone, or for two or more common chips and illumination elements or zones, of the cabinet system or installation. For example, one channel of the PCB can be connected to, and assigned to control, the chips or LED's of the light strip segments associated with Zone 1, which includes both the under-cabinet, countertop, or task lighting 24 and the accessory lighting 32 of the cabinet system or installation 20 in FIG. 1. Another channel of the PCB can be connected to, and assigned to control, the chips or LED's of the light strip segments associated with Zone 2, which includes the interior, glass door, cabinet lighting 28 of the cabinet system or installation 20 in FIG. 1. Another channel of the PCB can be connected to, and assigned to control, the chips or LED's of the light strip segments associated with Zone 3, which includes the soffit lighting 36 above the wall cabinets 26 of the cabinet system or installation 20 in FIG. 1. Another channel of the PCB can be connected to, and assigned to control at least power of, the chips or LED's of the light strip segments associated with Zone 4, which includes the interior lighting, when opened, of the solid door cabinets and/or drawers of the cabinet system or installation 20 in FIG. 1.

Each channel can be connected to the corresponding light strip segments for a specific zone and/or of the same type of lighting along the powered light strip. The powered light strip can thus have four connections, such as hard wire connections or wireless connections, from the PCB to the chips or illumination elements of the light strip segments. The connection for one channel can be connected only to the corresponding light strip segments of the powered light strip for a specific zone and/or of a specific lighting type. Those connections can bypass the light strip segments of the other zones and/or of the other types of lighting not assigned to that channel. Thus, one continuous powered light strip can be used to accommodate a cabinet installation or system with multiple lighting zones and having multiple different types of LED's or illumination elements. Further, only one power lead, gear or controller, and power connection is required for the installation. However, multiple power leads may be used to improve performance and simplify installation. Also, as represented in FIG. 4C, the powered light strip can include one or more auxiliary or branched light strip segments that branch off of a main powered light strip. These branches and a main powered light strip can be configured to accommodate a particular cabinet system or installation.

The disclosed powered light strips can be installed on hidden surfaces of a cabinet or the cabinet system or installation. If desired, the cabinetry can be created having face frame surfaces, with or without recessed grooves, channels, or dados, along hidden surfaces of the cabinet components. FIG. 6 shows such grooves, but it is very common to install light strips on flat surfaces of the cabinets, hidden by the frame parts of the cabinets. The powered light strips can be routed and seated on these surfaces or in these grooves when installed. The powered light strips, or portions thereof, can be pre-installed at the factory for the cabinets or can be installed at the installation site, if desired. The powered light strips can be fabricated in sections that can be attached to one another at the cabinet factory or at the installation site. Alternatively, the powered light strips can be pre-fabricated as one continuous strip or assembly prior to installation. If fabricated in sections, appropriate connections may be made at the ends of the light strip segments that are to be joined to one another, as described above.

In the completed cabinet system or installation, the face frame surfaces or the grooves, and thus the powered light strip, can be positioned to illuminate the desired space, region, or area of the cabinetry. For example, some of the face frame surfaces or the grooves, and portions of the powered light strip, can be outside of and exposed to the exterior of the cabinetry to illuminate spaces above or below various parts of the cabinet system or installation. For example, an arrangement can be used for the Zone 3 soffit lighting 36 and Zone 1 countertop, task, or under-cabinet lighting 24 as shown in FIG. 1. Some of the face frame surfaces or the grooves, and thus portions of the powered light strips, can be within and exposed to interior spaces of the cabinetry to illuminate such interior spaces of the cabinet system or installation. For example, an arrangement can be used for the Zone 2 interior lighting 28 of the glass door cabinets and the Zone 4 lighting of the solid door cabinets and drawers as shown in FIG. 1.

In other examples, the light strip segments can also vary from the examples disclosed and described above. The substrate material can be tape-like and substantially flexible or can be more rigid and linear. The illumination elements can also vary widely. LED's are highly suitable for the disclose cabinetry systems and installations. However, other types of elements may certainly be used or incorporated. Further, different types of LED's or illumination elements can be provided, depending on the effect desired for a given zone. Front facing or directing LED's may be utilized along one strip segment. Side emitting LED's may be utilized along another strip segment. Both types may be utilized along another strip segment. How the LED's are incorporated will also determine the lighting effect of a given strip.

Figure 7:
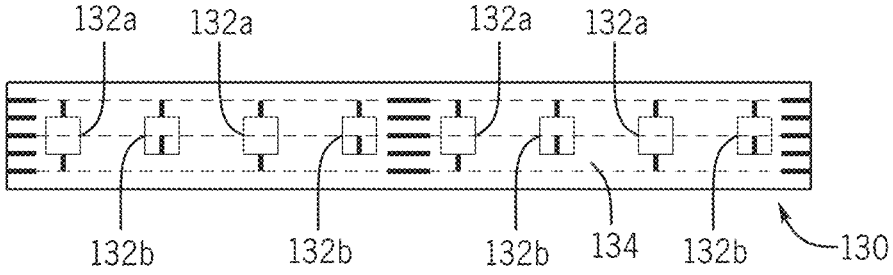
FIG. 7 shows a schematic view of another example of a printed circuit board configuration for light strip segments of the light strip of FIGS. 2, 4A, 4B, and/or 4C and in accordance with the teachings of the present disclosure.

In one example, represented in FIG. 7, one lighting strip segment 130 can include at least two different types of LED chips 132*a* and 132*b* or other illumination elements on the same strip substrate 134. In this example, the LED chips 132*a* and 132*b* are coupled to and powered independently by two different channels, i.e., channels two and four, respectively, of the channels on the segment. Thus, the LED chips 132*a* may be illuminated when the voltage channel and the second channel are powered and the LED chips 132*b* are illuminated when the voltage channel and the fourth channel are powered. Two different lighting elements or LED chips on the same strip segments, powered by two different channels, may be used to get different effects in same zone. The chips may provide two different colors, two different types of white light, to different illumination levels, or the like. Alternatively, the two different LED's may direct light in two different directions. In one example, the LED chips 132*a* may be front facing LED's, i.e., direct light normal or perpendicular relative to the plane of the strip substrate 134. The LED chips 132*b* may be side emitting LED's that direct light parallel or more parallel to the plane of the strip substrate. This may be useful to achieve two selectively different types of lighting, depending on usage, for the same area of the cabinetry. The side emitting LED's 132*b* and front facing LED's 132*a* on the same strip can thus be split off to be controlled separately, as in the disclosed example of FIG. 7, even though they are on a single strip segment. Alternatively, the side emitting LED's 132*b* and front facing LED's 132*a* on the same strip can both be powered and controlled with a single channel, both being illuminated simultaneously without independent control. This may be utilized to better illuminate a given area of the cabinetry, as desired.

The disclosed PCB form of the lighting strips and segments allows power to pass to subsequent strips on any and all channels. Any or all channels can be utilized on any particular lighting strip or segment to power LED's, whether it be one set of LED's for a particular channel or multiple sets of LED's on multiple channels of the same segment. The LED strips can be cut to length to meet the requirements of a particular cabinetry application. The ends of the strips can then be jointed, as needed. Many different types of lighting elements can be utilized in a given system, as long as each type is configured to be powered by the same DC source as the rest of the system. The same holds true for other power accessories and objects to be connected to the system.

The disclosed integrated lighting and power system can also be configured to provide additional features. For example, the lighting elements may be more sophisticated to provide dimming functionality, strobe functionality, and/or the like. The controller may also be programmed or configured to DIM, turn ON, turn OFF, or otherwise control one or more zones of a system according to season, time of day or night, latitude and longitude, time zone, daylight savings, weather characteristics, ambient light levels, and/or the like. The system can also include occupancy sensors to control one or more zones depending on the presence, absence, or continued presence or absence of room occupants in which the system resides. The system may be programmed to have a day/night setting as well.

Figure 8:
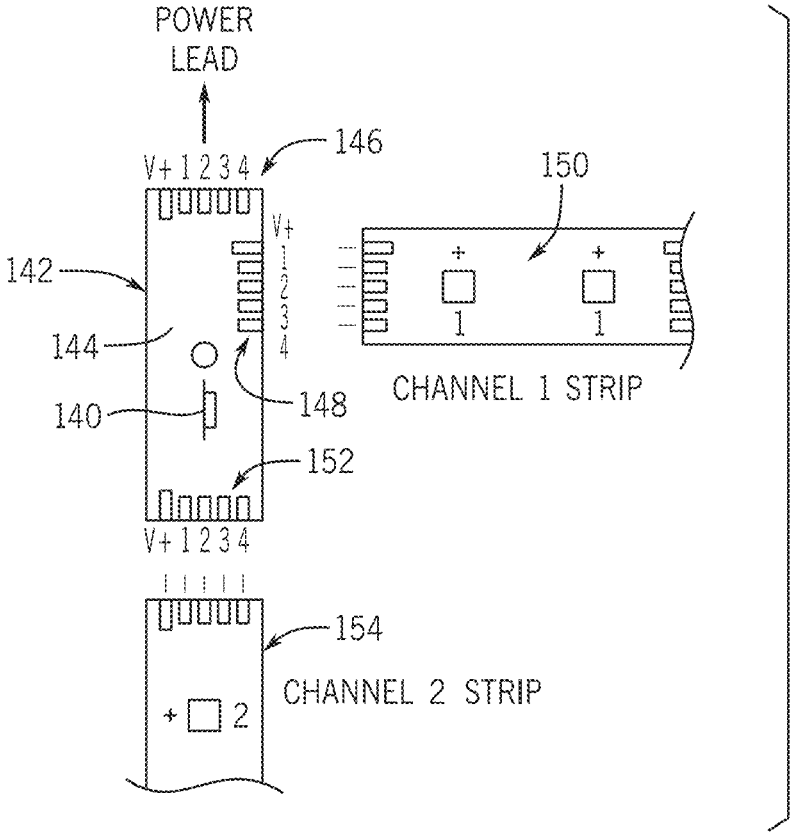
FIG. 8 shows a schematic view of a joint piece with a contact switch for use in joining light strip segments according to the teachings of the present disclosure.

As shown in FIG. 8, a switch 140, such as a reed switch, magnetic switch, or the like may be incorporated into either a joint piece 142, as shown, or a strip segment. In this example, the joint piece 142 can have a substrate 144 that may be a semi-rigid substrate material, such as a PCB fiber material. The joint piece 142 may have a set of lead contacts 146 for connecting to a power lead (not shown) that would extend to a controller of the system. The joint piece 142 may also have a second set of contacts 148, oriented 90 degrees relative to the power or lead contacts 146 and along a side of the joint piece. These second contacts 148 may be for connecting to a first light strip segment 150 of a system or powered light strip. The joint piece 142 may also have a third set of contacts 152 at another end of the substrate for connecting to a second light strip segment 154 of the system or powered light strip. The switch 140 can be configured to detect the opening or closure of a solid cabinet door or solid panel drawer. Upon opening of the drawer or door, the switch 140 can close the circuit of the appropriate channel to illuminate the opened drawer or cabinet. Upon closing of the door or drawer, the switch can turn off the LED's, even if the channel remains powered.

The disclosed integrated lighting and power solution provides a simple, minimalistic lighting system. The disclosed system is easy to install, easy to manufacture, and easy to use. The disclosed system can be operated with a single remote control configured to control multiple channels of the system. The disclosed system may include only a single power lead, thus requiring only a single connection to the controller and a power source. However, multiple power leads may be utilized, as noted above, with still only one connection of the entire system to a power source. The disclosed system also only requires one elongate powered light strip that can have multiple different segments. The segments can be provided and arranged to accommodate multiple different lighting zones and to accommodate multiple zones having different illumination and power requirements. However, also as noted above, the system can include multiple different powered light strips to adequately and easily cover an entire cabinetry system and installation. The disclosed system provides a lighting solution that offers tremendous design flexibility and functionality while utilizing only a very minimal number of very basic components.

One existing lighting solution that offers independent zone control requires the use of digital LED strips, which are very expensive. Digital LED strips carry individually addressable diodes and thus multiple associated controllers. For each cabinet size, arrangement, etc., one would need to count how many diodes are on each digital LED strip length and program those specific chips to respond to commands as a group. Such a digital solution is also limited to using multiple, specific power level strips. In one example, kitchens have many cabinet size options and arrangements in one cabinet system or installation. The digital approach would be very expensive and not practical.

During fabrication of the cabinets or a cabinet system, or during installation at the installation site, it may be necessary to drill holes or provide narrow slots for extending the powered light strip along the installation to reach the appropriate cabinets. For example, when connecting or routing the powered light strip to two adjacent cabinets, it may be necessary to drill a hole extending between the two cabinets so that the strip or a link can pass from one to the other while not being readily visible after installation. In another example, it may be necessary to drill a hole or provide a slot through one of the cabinets so that the powered light strip or a branch of the strip (or a lead for another component or accessory to be powered by the powered light strip) can reach from the main strip to the installation or mounting location.

In one example, the powered light strips can be entirely pre-fabricated and assembled prior to being installed on the cabinet system or installation. In another example, the powered light strips can be fabricated in sections that are installed and connected to one another, as noted above. In still another example, the installer may be asked to cut and trim the various light strip segments to desired lengths at the installation site or at the cabinet manufacturing site. The installer may then be required to add the suitable joints or to otherwise connect the segments to one another. This may also be done at the cabinet factory or the installation site. In one hard wired example, each light strip segment may have multiple hard wires extending the length of the segment. One of the hard wires may be connected to each LED or illumination element of the segment while the other hard wires simply bypass the LED's or illumination elements. During installation, the installer would need to properly connect the connectors from segment to segment or would need to individually connect the correct wires to one another from segment to segment during installation.

If desired, fewer than all of the cabinets for a given cabinet system or installation may be provided with a lighting feature. Those cabinets without lighting may be installed with a non-illuminated segment of the powered light strip or skipped entirely by having no portion of the system installed. As noted above, the driver of the powered light strips may be plugged into a wall outlet or socket at the installation site. Alternatively, the driver could instead be hard wired directly to the power source of the installation site, such as a traditional 120V AC system. The controller may include a multi-prong plug that plugs into the controller to connected to the power source. In any case, the connection to the power source may be a switched connection.

In general, one example of a method of installing the disclosed integrated light and power solution includes installing the DC driver on the cabinetry, installing the controller on the cabinetry and connecting it to the DC driver, installing each of the powered light strips to the cabinetry, and connecting the power lead or leads to the controller at the factory. Alternatively, sections and/or segments of the powered light strips can be installed on each of the cabinets of the system or at least on the cabinets selected for illumination. If desired, one or more powered devices, products, components, or accessories, such as the aforementioned fan, may be powered by the integrated lighting and power solution. Such components or accessories may also be installed on the cabinets at the factory or at the installation site. If the integrated lighting and power solution is pre-installed at the factory, the cabinets can then be shipped or delivered to a site for installation at the site. Any connections to power or among light strip segments or powered light strips can be made at the site, as needed. Alternatively, all or part of the integrated lighting and power solution can be installed on the cabinets at the installation site.

Some components or accessories may be more suitable for being installed and/or connected at the installation site. For example, a phone charger or charging system, a Bluetooth device, a Bluetooth speaker system, a tablet screen or display, or the like may be easily connected to a power module of the modular power system after the cabinet system 20 is installed. Other such components or accessories may be easier to mount or install at the factory, such as a fan or the like.

Although certain modular power systems, lighting systems, system components and accessories, and installation methods have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A cabinet system with integrated lighting and power, the cabinet system comprising:

a plurality of cabinets defining multiple illumination zones; and a powered light strip having a power lead, a multi-channel configuration, and a plurality of light strip segments connected to one another, each light strip segment having one or more illumination elements, wherein the power lead is connected or connectable to a power source, wherein at least a first segment of the plurality of light strip segments is connected to a first channel of the multi-channel configuration and at least a second segment of the plurality of light strip segments is connected to a second channel of the multi-channel configuration, and wherein the first and second channel and the first and second segments of the plurality of light strip segments are independently controllable, whereby the one or more illumination elements of the first segment can controllably and independently illuminate a first zone of the of the multiple illumination zones and the one or more illumination elements of the second segment can controllably and independently illuminate a second zone of the multiple illumination zones.

2. The cabinet system of claim 1, wherein the power lead is coupled to a power converter or direct current (DC) driver.

3. The cabinet system of claim 1, wherein the power lead is configured to be plugged into a controller configured to control the first and second segments.

4. The cabinet system of claim 1, wherein the powered light strip is at least partly pre-installed on the two or more cabinets at a cabinet manufacturing facility.

5. The cabinet system of claim 1, wherein the powered light strip is at least partly installed on the two or more cabinets at an installation site.

6. The cabinet system of claim 1, further comprising at least one component or accessory installed on one of the at least two cabinets, wherein the at least one component or accessory is powered by the powered light strip.

7. The cabinet system of claim 1, wherein the one or more illumination elements include light emitting diodes (LED's).

8. The cabinet system of claim 7, wherein the LED's on the first segment produce a different light characteristic than the LED's on the second segment.

9. An integrated lighting and power system for cabinetry, the system comprising:

a controller;

a power lead connectable to the controller;

a powered light strip coupled to the power lead, the powered light strip having multiple channels; and a plurality of light strip segments connected to one another forming the powered light strip, wherein each light strip segment has one or more illumination elements, wherein the controller is connected or connectable to a power source, wherein the one or more illumination elements of a first segment of the plurality of light strip segments is connected to a first channel of the multiple channels and the one or more illumination elements of a second segment of the plurality of light strip segments is connected to a second channel of the multiple channels, and wherein the first and second channel and the first and second segments of the plurality of light strip segments are independently controllable via the controller.

10. The system of claim 9, wherein the controller is coupled to a power converter or DC driver.

11. The system of claim 9, wherein the power lead is configured to be plugged into the controller.

12. The system of claim 9, wherein the multiple channels include four channels and a voltage channel.

13. The system of claim 12, further comprising four different light strip segment types, each segment type connected to a different one of the four channels.

14. The system of claim 13, wherein the different light strip segment types are differentiated by differences in at least one illumination characteristic of the respective one or more illumination elements of the four different light strip segment types.

15. The system of claim 13, wherein the plurality of light strip segments includes multiple segments of each of the four different light strip segment types.

16. The system of claim 15, wherein the plurality of light strip segments are arranged substantially in series and wherein the multiple segments of each of the four different light strip segment types are arranged directly adjacent to one another or dispersed, at least in part, among the segments of the other different light strip segment types.

17. The system of claim 9, wherein the one or more illumination elements are LED's.

18. The system of claim 17, wherein the LED's on the first segment produce a different light characteristic than the LED's on the second segment.

19. The system of claim 9, further comprising:

a DC driver couplable to an AC power source;

the controller connected to the DC driver;

a plurality of the powered light strips connected to the controller.

20. The system of claim 19, wherein at least two or more of the plurality of powered light strips are independently connected to the controller, and wherein common channels among the multiple channels of the plurality of powered light strips are controllable together and independent of other channels of the multiple channels.

* * * * *